US007556268B2

(12) United States Patent
Bateman et al.

(10) Patent No.: US 7,556,268 B2
(45) Date of Patent: Jul. 7, 2009

(54) DROP TARGET

(75) Inventors: Kyle Bateman, Provo, UT (US); Tom Wright, Highland, UT (US); David Bassett, Springville, UT (US)

(73) Assignee: Action Target, Inc., Provo, UT (US)

( * ) Notice: Subject to any disclaimer, the term of this patent is extended or adjusted under 35 U.S.C. 154(b) by 19 days.

(21) Appl. No.: 11/690,688

(22) Filed: Mar. 23, 2007

(65) Prior Publication Data

US 2007/0235943 A1 Oct. 11, 2007

Related U.S. Application Data

(60) Provisional application No. 60/788,086, filed on Mar. 31, 2006.

(51) Int. Cl.
*F41J 7/04* (2006.01)

(52) U.S. Cl. ..... 273/406

(58) Field of Classification Search ..... 273/378–393, 273/403–410
See application file for complete search history.

(56) References Cited

U.S. PATENT DOCUMENTS

| | | | | | |
|---|---|---|---|---|---|
| 891,566 | A | * | 6/1908 | Reid | 273/406 |
| 1,266,494 | A | * | 5/1918 | Lakin | 273/383 |
| 1,341,814 | A | * | 6/1920 | Mosby | 273/385 |
| 1,348,283 | A | | 8/1920 | Koehl | |
| 1,435,768 | A | * | 11/1922 | Wang | 273/392 |
| 1,559,171 | A | | 10/1925 | Knowles | |
| 1,657,931 | A | * | 1/1928 | Krantz | 273/389 |
| 1,738,874 | A | | 12/1929 | Domingo | |
| 2,008,359 | A | | 7/1935 | Lamb | |
| 2,039,552 | A | | 5/1936 | Reynolds | |
| 2,085,933 | A | | 7/1937 | Vaughan | |
| 2,104,171 | A | | 1/1938 | Schwerin | |
| 2,372,111 | A | | 3/1945 | Norberg | |
| 2,587,042 | A | | 2/1952 | Haiselup | |
| 2,613,080 | A | * | 10/1952 | Dow | 273/383 |
| 2,613,934 | A | | 10/1952 | Tabler | |
| 2,670,959 | A | | 3/1954 | Broyles | |
| 2,706,634 | A | | 4/1955 | Van Valkenburg | |
| 2,819,903 | A | | 1/1958 | Saunders | |
| 2,905,469 | A | * | 9/1959 | Taylor | 273/380 |
| 3,014,725 | A | | 12/1961 | Lewis | |
| 3,348,843 | A | | 10/1967 | Stanley | |
| 3,392,980 | A | | 7/1968 | Ortega | |
| 3,515,388 | A | | 6/1970 | Zachmeier | |
| 3,914,879 | A | | 10/1975 | Taylor, III | |

(Continued)

FOREIGN PATENT DOCUMENTS

GB 2 187 270 9/1987

OTHER PUBLICATIONS

U.S. Appl. No. 10/287,191, filed Nov. 4, 2002, Bateman et al.

(Continued)

*Primary Examiner*—Mark S Graham
(74) *Attorney, Agent, or Firm*—Bateman IP Law Group

(57) ABSTRACT

A drop target includes a first target seen by a shooter and a second target concealed behind the first target. When the shooter hits the second target, the first target moves, thereby representing that the shooter as hit a desired "kill zone" and should cease shooting.

10 Claims, 7 Drawing Sheets

U.S. PATENT DOCUMENTS 4,090,714 A * 5/1978 Izushi ..... 463/52
4,232,867 A 11/1980 Tate, Sr.
4,288,080 A 9/1981 Laporte et al.
4,524,976 A * 6/1985 Seitz et al. ..... 273/388
4,540,182 A 9/1985 Clement
4,614,345 A 9/1986 Doughty
4,657,261 A 4/1987 Saunders
4,726,593 A 2/1988 Wade
4,739,996 A 4/1988 Vedder
4,743,032 A 5/1988 Summers et al.
4,911,453 A 3/1990 Essex et al.
5,163,689 A 11/1992 Bateman et al.
5,232,227 A 8/1993 Bateman
5,240,258 A 8/1993 Bateman
5,257,790 A * 11/1993 Meadows ..... 273/389
5,263,721 A 11/1993 Lowrance
5,324,043 A 6/1994 Estrella
5,346,226 A 9/1994 Block
5,350,180 A 9/1994 Acock
5,352,170 A 10/1994 Condo et al.
5,400,692 A 3/1995 Bateman et al.
5,433,451 A 7/1995 De Vries
5,535,662 A 7/1996 Bateman et al.
5,676,378 A * 10/1997 West ..... 273/390
5,811,718 A 9/1998 Bateman et al.
5,822,936 A 10/1998 Bateman et al.
5,865,439 A * 2/1999 Marcuson et al. ..... 273/406
5,934,678 A 8/1999 Theissen et al.
5,947,477 A 9/1999 Turnipseed
6,311,980 B1 11/2001 Sovine et al.
6,325,376 B1 12/2001 Elliott et al.
6,378,870 B1 4/2002 Sovine et al.
6,484,990 B1 11/2002 Marshall et al.
6,502,820 B2 1/2003 Slifko
6,533,280 B1 3/2003 Sovine et al.
6,575,753 B2 6/2003 Rosa et al.
6,588,759 B1 7/2003 Bateman et al.
6,679,795 B2 1/2004 Ouimette et al.
6,776,418 B1 8/2004 Sovine et al.
6,808,177 B2 10/2004 Dehart
6,808,178 B1 10/2004 Sovine et al.
6,896,267 B1 5/2005 Le Anna
6,975,859 B1 12/2005 Lambert et al.
6,994,348 B2 2/2006 Lambert et al.
6,994,349 B2 2/2006 Lambert et al.
7,128,321 B1 * 10/2006 Brown ..... 273/392
7,140,615 B1 11/2006 Sovine et al.
7,175,181 B1 2/2007 Bateman et al.
7,194,944 B2 3/2007 Lambert et al.
7,219,897 B2 5/2007 Sovine et al.
7,234,890 B1 6/2007 Marshall et al.
7,264,246 B2 9/2007 Sovine et al.
7,275,748 B2 10/2007 Lambert et al.
7,303,192 B2 12/2007 Marshall et al.
7,306,230 B2 12/2007 Lambert et al.
7,322,771 B1 1/2008 Marshall et al.
2005/0022658 A1 2/2005 Bateman et al.
2006/0234069 A1 10/2006 Sovine et al.
2006/0240388 A1 10/2006 Marshall et al.
2006/0240391 A1 10/2006 Sovine et al.
2006/0290064 A1 * 12/2006 Hagar ..... 273/392
2007/0040334 A1 2/2007 Marshall et al.
2007/0045965 A1 3/2007 Bateman et al.
2007/0069472 A1 3/2007 Lambert et al.
2007/0072537 A1 3/2007 Bateman et al.
2007/0102883 A1 5/2007 Parks et al.
2007/0114724 A1 5/2007 Bassett et al.
2008/0022847 A1 1/2008 Bateman et al.

OTHER PUBLICATIONS

U.S. Appl. No. 11/494,788, filed Jul. 26, 2006, Bateman et al.
U.S. Appl. No. 11/349,739, filed Feb. 8, 2006, Bateman et al.
U.S. Appl. No. 11/349,738, filed Feb. 8, 2006, Bateman et al.
U.S. Appl. No. 11/506,763, filed Aug. 18, 2006, Sovine et al.
U.S. Appl. No. 11/506,413, filed Aug. 17, 2006, Wright et al.
U.S. Appl. No. 11/530,280, filed Sep. 8, 2006, Marshall et al.
U.S. Appl. No. 11/745,077, filed May 7, 2007, Bassett et al.
U.S. Appl. No. 11/781,187, filed Jul. 20, 2007, Bateman et al.
Caswell International Corp., Product Literature, Copyright 2002.
Porta Target, Product Literature, Circa 2000.

* cited by examiner

DROP TARGET

RELATED APPLICATIONS

The present application claims the benefit of U.S. Provisional Patent Application No. 60/788,086, filed Mar. 31, 2006, which is incorporated herein in its entirety.

BACKGROUND OF THE INVENTION

1. Field of the Invention

The present invention relates to a target for improving training techniques. More particularly, the present invention relates to a target which provides improved visual response to a person hitting a "kill zone" of the target.

2. State of the Art

It is crucial during the training of police officers and the like that they be trained in real life situations. Law enforcement target training originally involved shooting at a still target from a pre-determined distance and then checking how many of the shots hit a kill zone on a particular target. Over time, however, such firearm training has been deemed to be inadequate to prepare police officers and other law enforcement officials to respond to real life situations. For example, an individual may be wearing a bullet-proof vest. In such a situation five shots directly to the heart may have little effect on the perpetrator other than to cause bruising in the chest. At the same time the police officer and innocent civilians are exposed to fire from the perpetrator.

In a situation where a law enforcement official is shooting at a suspect, the police officer or other law enforcement officer has determined that the individual poses a serious risk of loss of life to either the officer or to others. Thus, once an officer makes the decision to discharge his/her weapon, he/she is often required to shoot to kill.

Because a perpetrator may be wearing a bullet-proof vest, a helmet, or other protective clothing, police officers are trained to fire in a sequence which is most likely to kill or seriously wound the perpetrator. Thus, for example, the police officer may be taught to fire three shots to the chest and then two shots to the head in quick succession. If the perpetrator is using a bullet-proof vest the shots to the chest will likely not immobilize the perpetrator. However, the shots to the head will.

While shooting in the desired scenario is important, it is also important for the police officer to stop shooting as soon as possible. Contrary to the belief of many, handguns are not highly accurate weapons. Every shot that the officer makes raises the possibility of a stray bullet ricocheting and hurting innocent civilians. Additionally, once the perpetrator drops to the ground, continued firing may hit people or items behind the perpetrator or result in ricochets that can harm innocent civilians.

In training with still targets, it is difficult to teach an officer to follow the sequence but to stop at the appropriate time. For example, the officer may shoot three shots to the chest which would have killed the perpetrator. However, because the target is non-reactive, the officer continues to fire two shots to the head. If the perpetrator has already fallen, the two shots to the head would significantly increase the risk of harming innocent third parties.

It is very important to train police officers so that they are comfortable with their reactions to given scenarios. A police officer who is confident in his/her shooting abilities is less likely to accidentally discharge their weapon and hurt someone. Additionally, they are also less likely to hesitate inappropriately when they are required to use deadly force.

Thus there is a need for an improved method for training police officers, other law enforcement officials and the military.

SUMMARY OF THE INVENTION

It is an object of the invention to provide an improved training target.

It is an object of the invention to provide a target which is easy to use.

The above and other objects of the invention are achieved in a drop target having a base for supporting a target, a first, penetrable target and a second reactive target. The reactive target is disposed so as to provide a visual change in the penetrable target and thereby identify to an officer that he/she has struck the "kill zone" and should cease shooting. In accordance with one aspect of the invention, the first, penetrable target is generally opaque and positioned in front of the second, reactive target so the shooter cannot see the second reactive target while shooting at the first penetrable target.

In accordance with another aspect of the invention, the second reactive target is connected to a catch or other similar mechanism which holds the first, penetrable target in place. When the second, reactive target is properly stuck by a bullet, the catch, etc, is released so as to enable the first, penetrable target to move and provide a visual indication that the kill zone was hit.

In accordance with the another aspect of the current invention, the second, reactive target is adjustable so as to selectively change the position of the second reactive behind the first penetrable target so as to more fully train law enforcement officials and the like.

Figure 1:
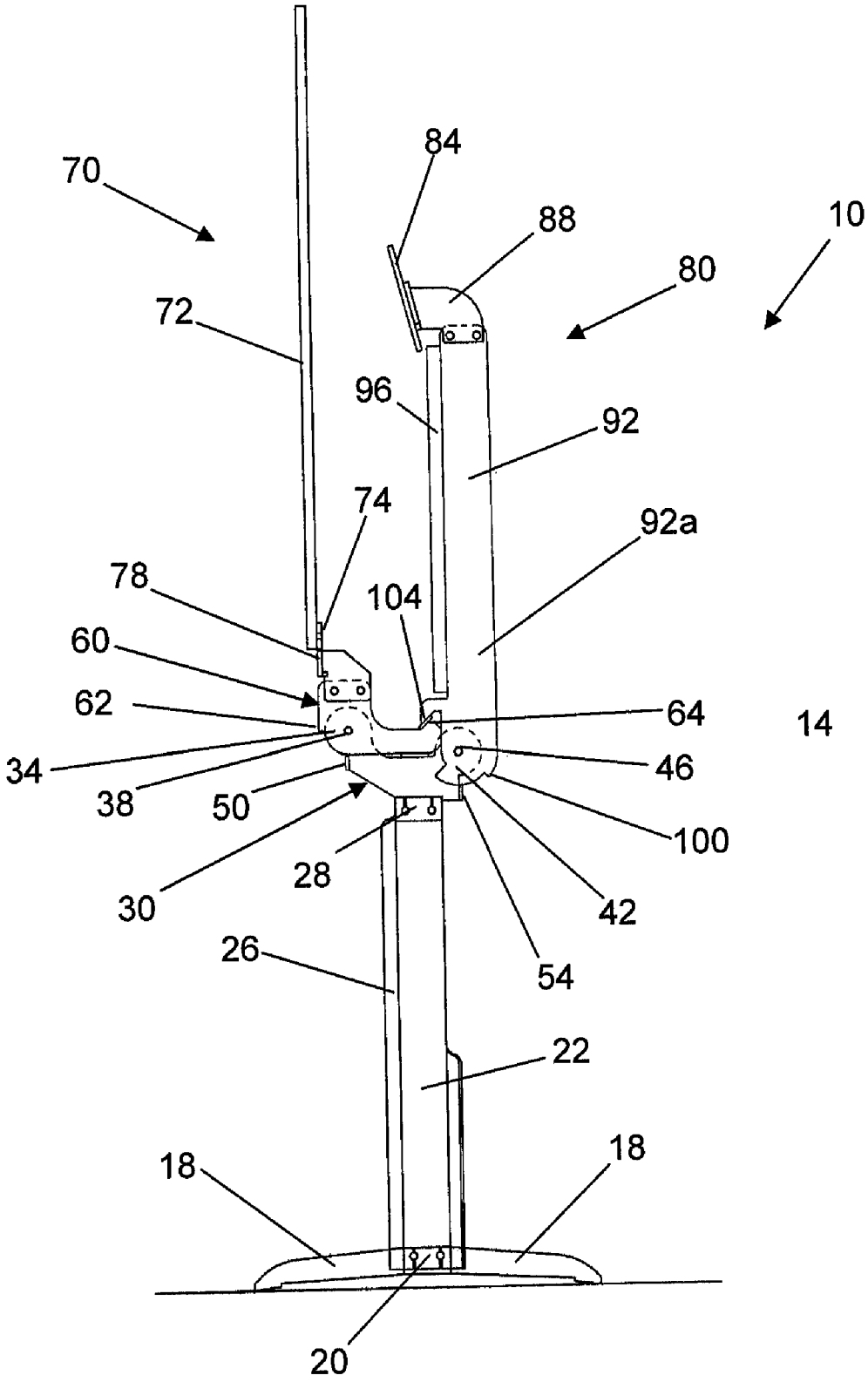
FIG. 1 shows a side view of a drop target made in accordance with principles of the present invention.

It will be appreciated that the drawings are illustrative of the principles of the invention and are not intended to limit the appended claims. Furthermore, it will be appreciated that the various aspects of the embodiments discussed therein can be used interchangeably between embodiments and representatives of the embodiments are provided with the different features mainly for the sake of clarity. The various configurations shown in the drawings can be used interchangeably and are provided separately merely to show varying options provided by the present invention.

DETAILED DESCRIPTION

The present invention will now be discussed with respect to the drawings so as to enable one of ordinary skill in the art to make and use the invention. It would be appreciated that the description is illustrative only and is not meant to limit the scope of the appended claims.

Turning now to FIG. 1, there is shown a side view of a drop target, generally indicated as 10 made in accordance with the principles of the present invention. The drop target 10 includes a base portion, generally indicated as 14. As shown in FIG. 1, the base portion 14 includes a plurality of feet 18 which is attached to a support 22 and extend outwardly so as to hold the support 22 generally vertically. A deflector plate 26 is attached to the front of the support 22 so as to minimize impact of bullets against the support 22. It would be appreciated that the support 22 can be a piece of tube steel, a steel 2×4, or any other appropriate support member. The deflector plate 26 will generally be a piece of angle steel and more preferably an angle piece of bullet proof steel such as AR400 or AR500 steel.

Attached to an upper portion of the support member 22 is a pivot plate 30. The attachment between the pivot plate 30 and the support member 22 can be performed by a variety of means, including attachment by rivets, by bolts, by welding, by adhesive attachment, or by clamps or other removable attachments, etc.

The pivot plate 30 includes a plurality of arms including a first arm 34 which engages a first target pivot 38. A second arm 42 engages a second target pivot 46 which will be explained in detail below.

The pivot plate 30 also includes a first stop 50 which is disposed to engage a first stop mechanism discussed below. The pivot plate 30 also includes a second stop 54 which is configured to stop movement of a second target as described below.

The first arm 34 of the pivot plate 30 is attached to a latch 60. The latch 60 includes a stop 62 which engages the stop 50 of the pivot plate 30 so as to limit downward movement of the latch 60 as it pivots about the first target pivot 38. The latch 60 also includes a catch 64 which, as it will be explained below, engages a catch arm of a second target so as to selectively hold the latch 60 into position shown in FIG. 1.

The latch 60 is connected to a first target mechanism 70. The first target mechanism 70 is preferably provided with a penetrable target 72 at which a law enforcement offer, etc, shoots such that bullets and other projectiles pass through the target. The target mechanism 70 includes the target 72 which is secured at the bottom by a mount 74. The mount shown in FIG. 1 is attached to target attachment 74 which is part of a mount 78. The mount 78 is also attached to the latch 60. When the latch 60 is held in the position shown in FIG. 1, the target 72 is held generally vertical and is disposed for target practice by law enforcement officers and alike.

Also attached to the pivot plate 30 is a second target mechanism, generally indicated as 80. The second target mechanism includes a reactive target 84. While target 84 may be penetrable by bullets, it is presently preferred that the target not be penetrable so that it can withstand a significant number of hits by a bullet. The target 84 may have an attachment 88 for connecting a target to a neck or arm 92. As shown in FIG. 1, the arm 92 extends generally vertically. However, other configurations could also be used.

A deflector plate 96 is preferably placed in front of the neck 92 so as to protect the neck from being hit by bullets. Additionally, the deflector plate 96 is preferably angled such that a bullet impacting the deflector plate will tend to ricochet off and will not transmit substantial force against the arm 92. A lower end 92A of the arm 92 includes a stop 100 which engages the stop 54 of the pivot plate 50 so as to limit downward movement of the arm 92 as it rotates about pivot 46. It will be appreciated that pivot 38 and 46 can be formed from bolts, rivets, or any other mechanism which allows latch 60 and arm 92 to pivot thereabout.

The lower end 92A of the neck 92 also includes a catch arm 104. As shown in FIG. 1, the catch arm 104 engages the catch 64 of the latch 60. In the position of FIG. 1, the target mechanism 70 stays in the position shown so long as the neck 92 stays in the position shown because the catch arm 104 holds the latch 60 in place.

Figure 2:
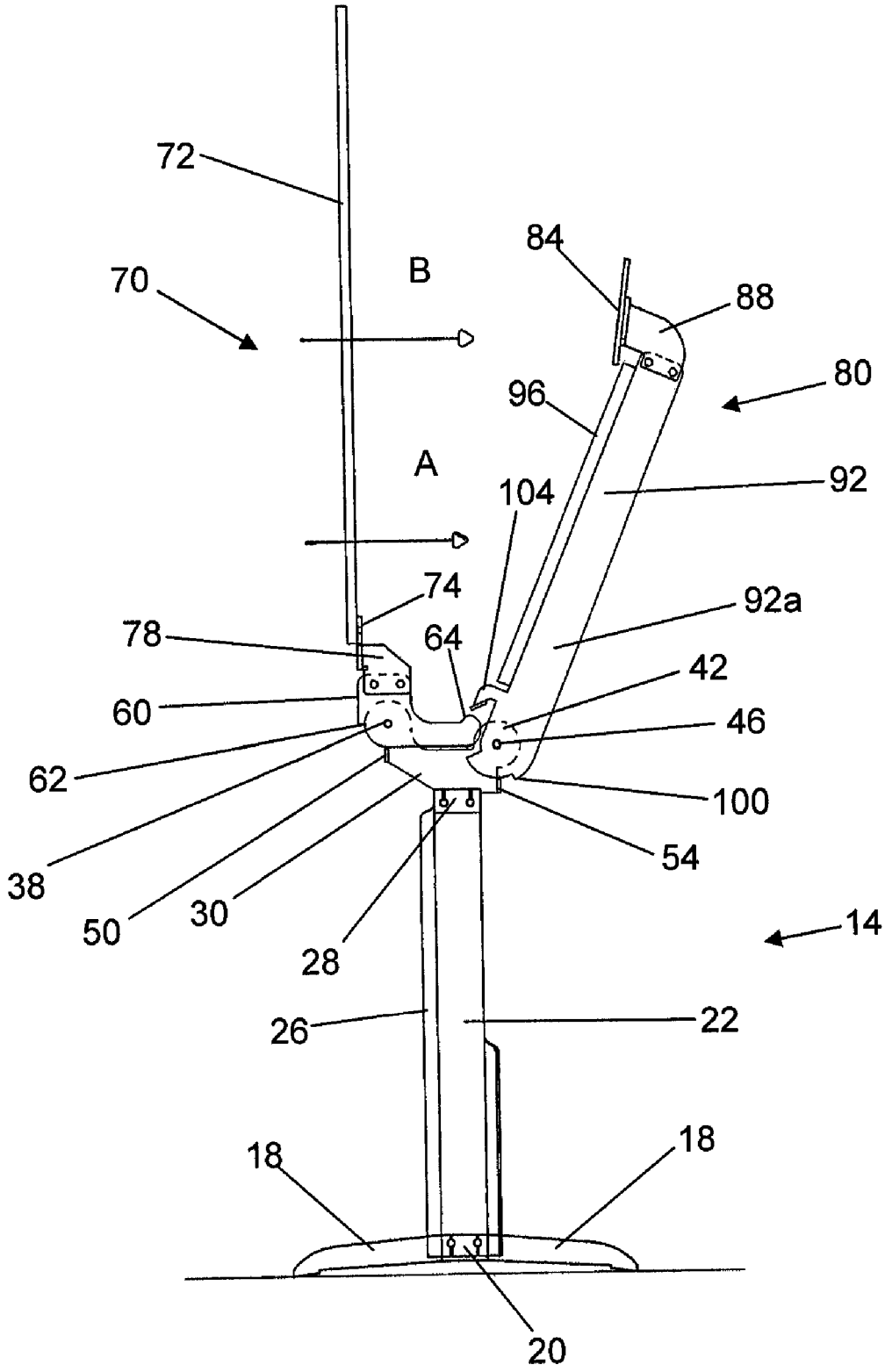
FIG. 2 shows a side view of the drop target of FIG. 1 wherein the drop target has been activated by a bullet hitting the second, reactive target mechanism.

Turning now to FIG. 2, there is shown a side view of the embodiment of FIG. 1 which is numbered accordingly. During target practice, a law enforcement officer or the like would shoot at the target 72. Bullets impacting the target 72 pass through the target as indicated by arrow A and arrow B. If the bullet does not pass through the desired kill zone, as indicated by arrow A, the bullet will impact the deflector plate 96 disposed in front of the neck 92 and ricochet into a bullet trap or some other containment device as is well known in the art. If, however, the bullet passes through the desired kill zone, as indicated by arrow B, the bullet will impact the second, reactive target 84. The force of the bullet hitting the reactive target 84 will cause the reactive target to move rearwardly, thus causing the arm 92 to pivot about pivot 46. As the arm 92 pivots rearwardly, the catch arm 104 is no longer disposed over the catch 64 of the latch 60. The arm 92 will continue to pivot rearwardly under the force of gravity until stop 100 on the arm engages stop 54 on the pivot plate. It will be appreciated that either stop 100 or 54 could have a pad such as the rubber pad indicated on 54 in FIG. 2.

Figure 3:
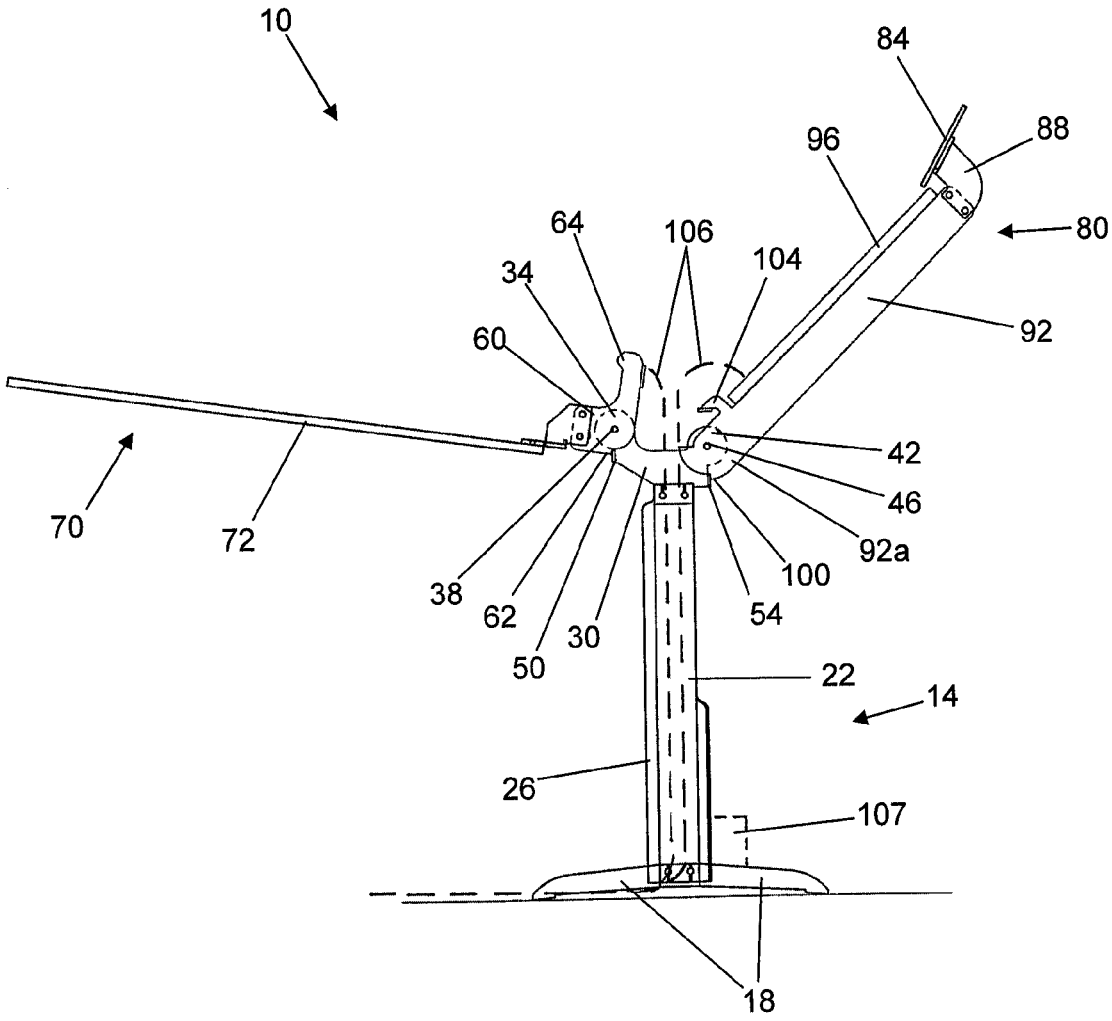
FIG. 3 shows a side view of the drop target of FIG. 1 and FIG. 2 in a static, resting state after the first, penetrable target has reacted to the movement of second, reactive target.

Turning now to FIG. 3, there is show a view of the drop target 10 in a static, resting position. Once the catch arm 104 no longer engages the catch 64, the latch 60 is able to rotate about pivot 38 to thereby change its relative position to pivot plate 30. This allows the first target mechanism 70, and in particular target 72, to pivot forward so the target is no longer exposed to the shooter. The fall of the target is stopped by stop 62 engaging stop 50 of the pivot plate 30. As with stop 54, a piece of rubber or some other material may be provided to minimize jarring when the stop is engaged.

Thus, the target provides a more realistic response to the officer shooting. The officer may fire three shots into the chest but not produce a kill because a perpetrator is wearing a bullet proof vest. However, the first shot to the head passes through the target 72 and hits the reactive target 84. This in turn causes the arm 92 to pivot backwardly and allows the target 72 to pivot forwardly visually representing the suspect has been killed or incapacitated to the point that he or she no longer poses a threat. This provides a more realistic visual indication to the officer that he or she should cease shooting. If the officer continues to shoot, then the officer would need to undergo additional training to improve decision making in such scenarios. In order to repeat the exercise, the first target mechanism 70 need merely be rotated back so that the target 72 is substantially vertical. The arm 92 is then lifted back into a generally vertical position so that the catch arm 104 again engages the catch 64 and holds the target 72 in place. One significant advantage of this configuration is that it does not require any electronic mechanisms. Thus, the target 72 can be set up in a variety of environments without concern for protecting electronic components and the like. It would be appreciated, however, that the remote access could be provided. For example, cable 106 could be provided. The cable 106 could allow manual remote setting by simply pulling the cable 106 to cause the first target mechanism 70 and the second target mechanism 80 to come back into the vertical positions. In the alternative, the device could be connected to a motor, such as 107 and then be powered from the remote location to automatically reset the target.

Figure 4:
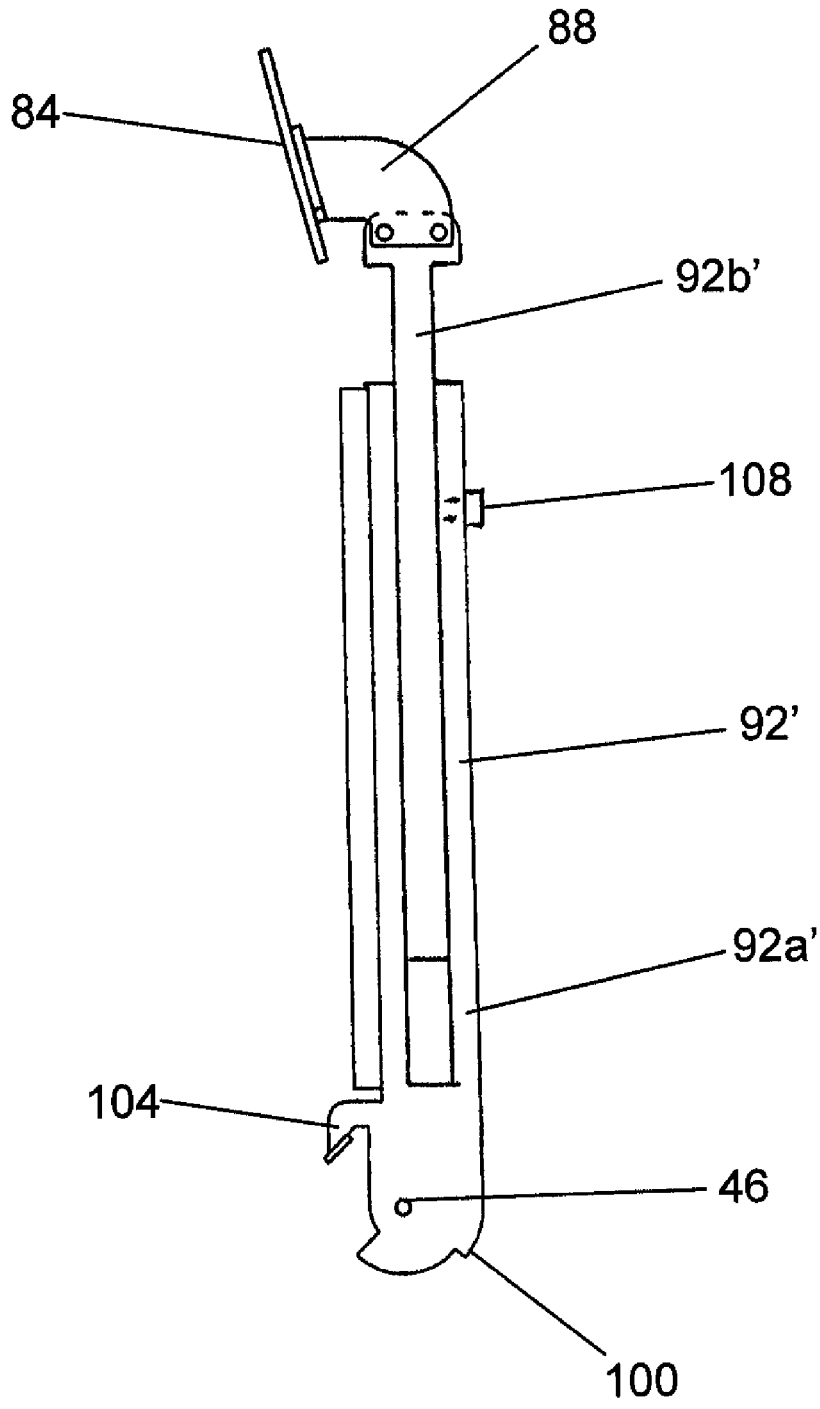
FIG. 4 shows a side view of an alternate embodiment of the reactive target mechanism.

Turning now to FIG. 4, there is shown a side view of an alternate embodiment of the arm 92'. The arm 92' includes a lower end 92*a*' which engages a pivot 46 and includes a stop 100 and catch arm 104. The arm 92' also includes an upper, adjustable arm portion 92*b*' which is slidable or otherwise movable with respect to the lower portion 92*a*'. Attachment mechanism 108 can be also provided to facilitate adjustment between the lower end 92*a*' and the upper portion 92*b'*.

An advantage of the arm 92' shown in FIG. 4 is that it allows the "kill zone" to be adjusted. If an officer is conditioned so that the kill zone is always at the perpetrator's head, he or she will likely react in the real life situation by instinctively firing for the head, rather than automatically firing three rounds to the chest and two rounds to the head. Additionally, even if he or she properly fires the initial rounds at the chest, he or she may continue firing until both rounds to the head have been fired. However, if any of the first three rounds has completely incapacitated the perpetrator, it may not be advisable to continue firing. Thus, having an adjustable arm 92 improves decision making by law enforcement officers by training them to act based on circumstance and not follow one particular routine. By adjusting the height or positioning of the second reactive target 84, the kill zone is selectively moved to a desired location. Thus, the police officer will not be preconditioned to the target falling after a proper shot in one zone, but rather will be conditioned to properly react to the situation.

Figure 5:
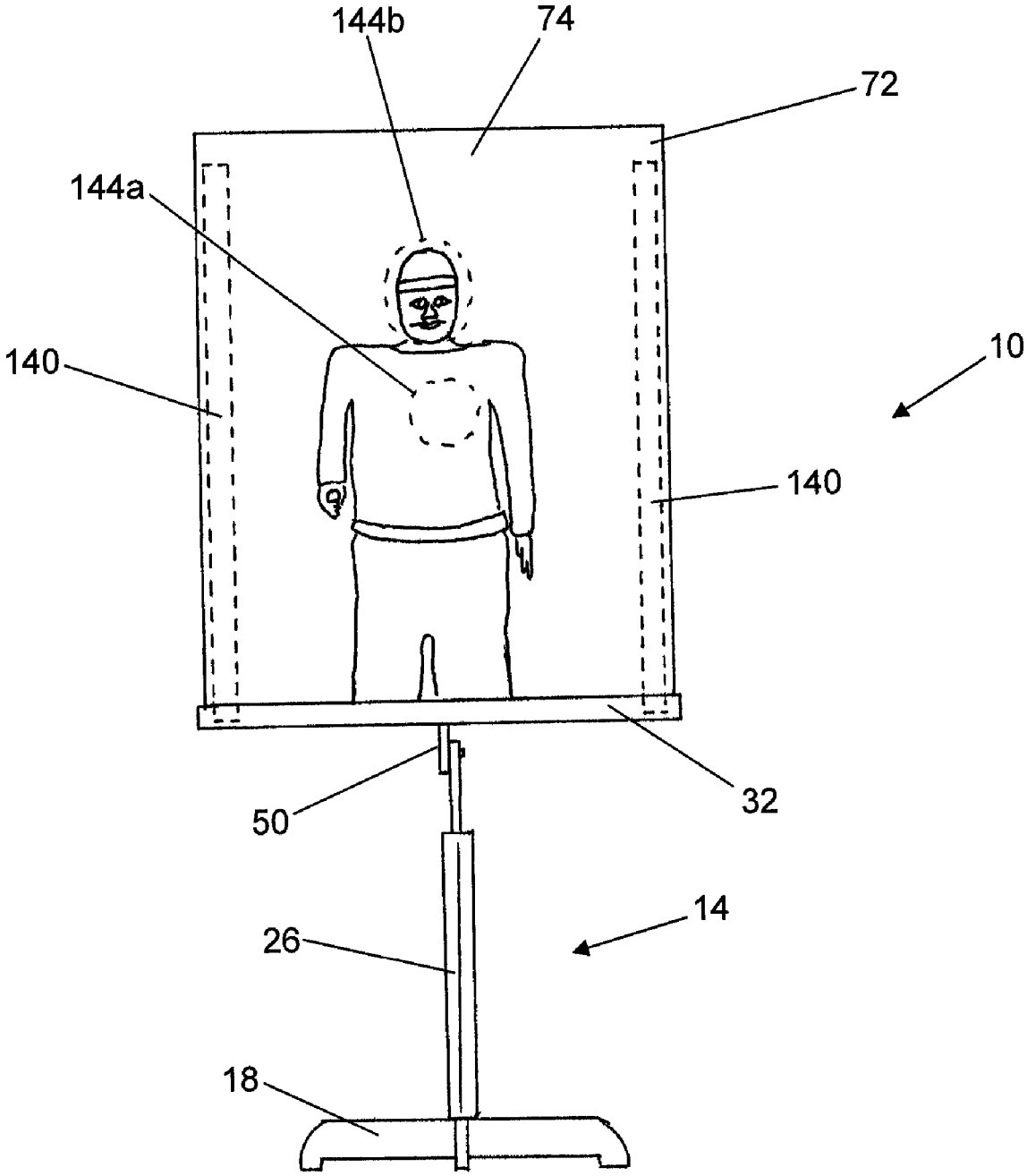
FIG. 5 shows a front view of a drop target in the loaded position.

Turning now to FIG. 5, there is shown a front view of the drop target, generally indicated as 10. The drop target 10 includes the feet 18 and the deflector plate 26 which form part of the base portion 14. Those skilled in that art will appreciate that the support 22 is hidden behind the deflector plate 26. The pivot plate 30 extends upwardly and engages an attachment plate 32. One common type of target 72 is formed by attaching a sheet of material 74, such as paper or cardboard to a pair of supports 140. The supports 140 are often made from 2×1 wood or other materials which hold the target material 74 generally vertical during use. Also shown in FIG. 5 are 2 potential kill zones 144*a* and 144*b*. By utilizing the arm 92' shown in FIG. 4, the kill zone can be adjusted to any particular location that is conducive with the target. Thus, a variety of different targets can be used and the kill zone 144*a* or 144*b* can be adjusted so that law enforcement officers are be presented with a variety of scenarios. By teaching the officers to properly react to each scenario, confidence in their decision making ability will generally be increased. This in turn reduces the risk of an officer shooting when such is not appropriate and reduces the risk of an officer unreasonably delay shooting when such as necessary to protect his or her own life or that of innocent bystanders.

Figure 6:
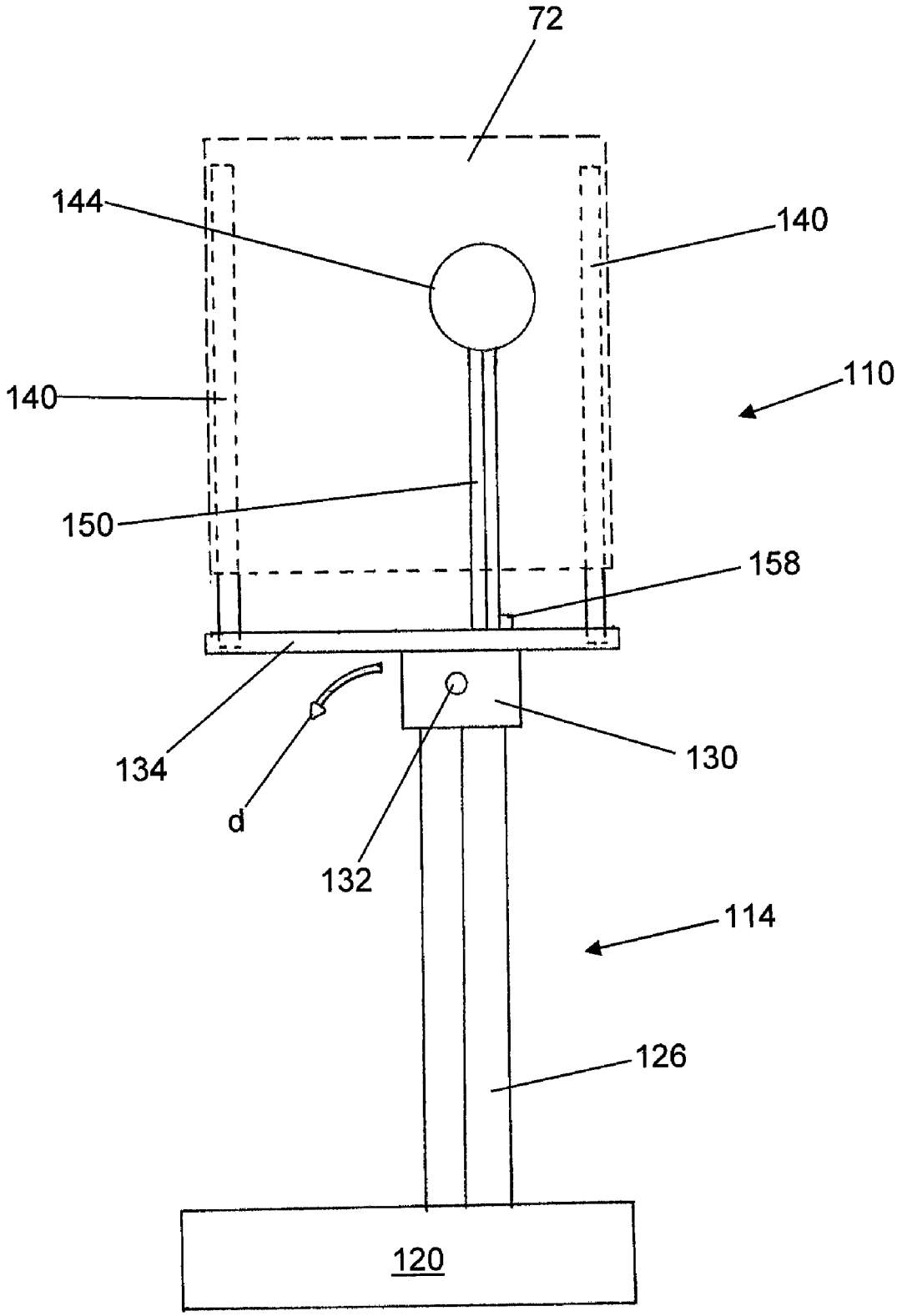
FIG. 6 shows a front view of an alternate configuration of the drop target.

Turning now to FIG. 6, there is shown a front view of an alternate configuration of a drop target, generally indicated 110. The drop target 110 includes a base portion, generally indicated 114. The base portion can include a retaining structure such as a cement wall 120, or a movable base. A deflector plate 126 is shown to protect a support 122 (FIG. 7).

Disposed above the deflector plate 126 is a pivot plate 130. The pivot plate 130 rotates about a pivot 132. The pivot plated 130 is also attached to a mount 134 which receives the support 140 of a target 72.

Figure 7:
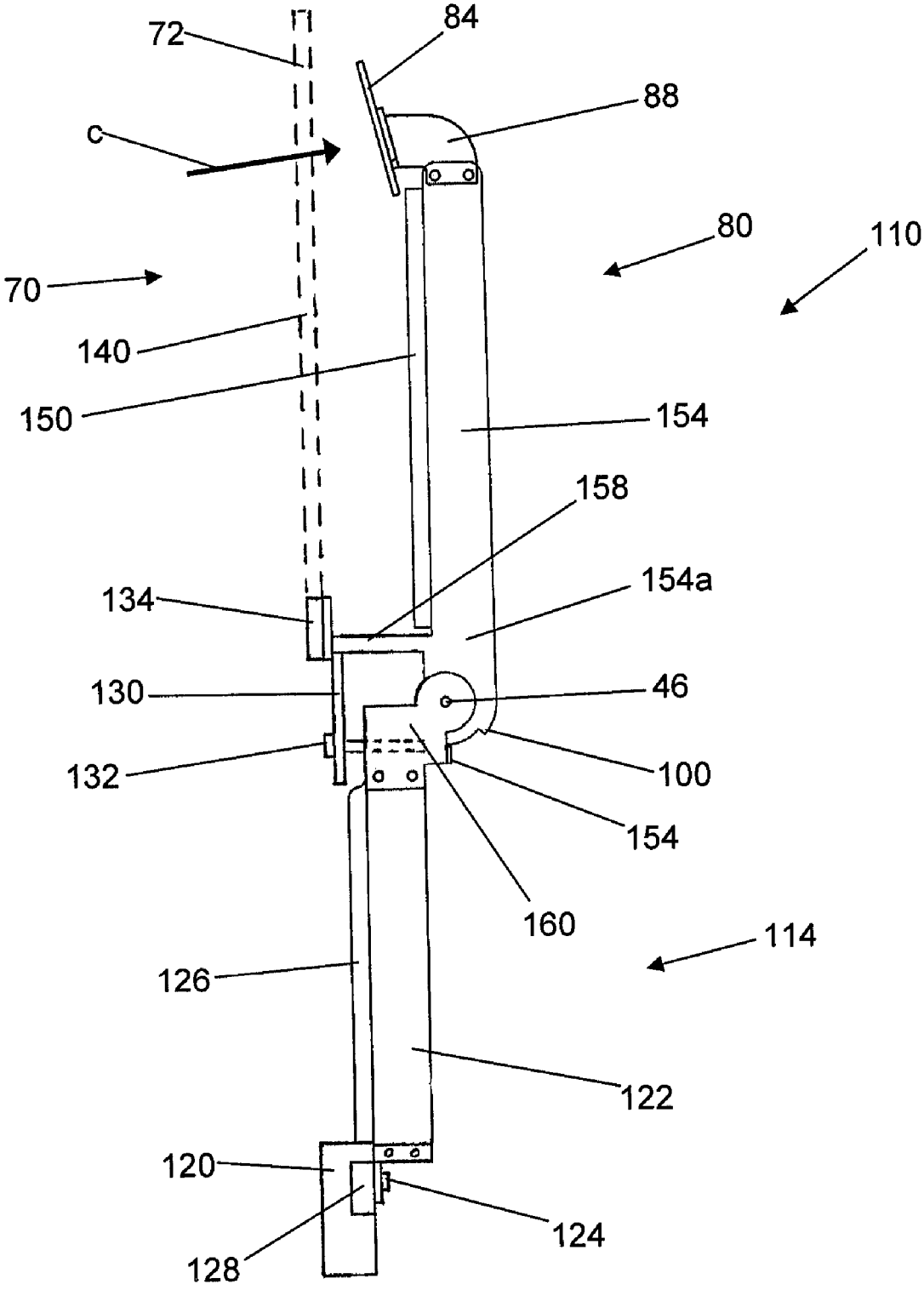
FIG. 7 shows a side view of the drop target of FIG. 6.

Also shown in FIG. 6 is a catch arm 158 which is attached to an arm 154 (FIG. 7). As will be discussed below, the arm 158 engages the mount 134 of the pivot plate 130 to prevent rotation of the pivot plate and the associated movement of the target.

Turning now to FIG. 7, there is shown a side view of the drop target 110. As mentioned, the support 122 of the base portion 114 is attached to a cement retaining wall 120. This can be done by a bolt 124 or by any other attachment mechanism. Additionally, if desired, a rail 128 can be integrated into any sort of attachment mechanism so as to allow the drop target 110 to facilitate movement of the drop target 100 either between use or during use.

When a shooter fires through the target 72 of the first target mechanism 70, as represented by arrow C, the bullet impacts the reactive target 84. The force of the bullet pushes the reactive target 84 rearwardly. As the reactive target 84 moves, the attachment 88 and arm 154 which connects the reactive target to the pivot plate 160 also move. This causes the arm 154 to rotate about pivot 146. The rearward movement of the arm 154 raises the catch arm 158 which is attached to a lower portion 154*a* of the target arm 154. The catch arm 158 extends to a position where it prevents rotation of a target pivot plate 130. Once the catch 158 is raised, the weight of the target mechanism 72 (or a force applicator, such as a spring) causes the pivot plate 130 to rotate as represented by arrow d in FIG. 6. This in turn causes the target to rotate downwardly, indicative of a person who has become incapacitated. In order to reset the trap, the pivot plate 130 is rotated back into the position shown in FIG. 6 and the arm 154 is lifted so as to be in the position shown in FIG. 7 so as to the catch arm 154 again prevents rotation of the pivot plate. Thus, when a shooter fires as indicated by arrow C and hits the reactive target 84, the target 72 will rotate out of the view thereby providing a visual indication to the officer that he or she should cease shooting.

Thus, there is disclosed a drop target which provides improved visual indication of when the shooter has hit the proper "kill zone" of a target. Those skilled in the art will appreciate the numerous modifications can be made without departing from scope of the spirit of the invention. For example, while described herein as utilizing gravity to pull the first target mechanism into a second position wherein it is no longer presented to the shooter, springs or other biasing elements can be used to more quickly move the target from presentation upon release of the catch mechanism The appended claims are intended to cover such modifications.

What is claimed is:

1. A target system comprising:

a first, penetrable target disposed in a generally vertical position;

a second, reactive target disposed so as to be concealed by the first penetrable target; and a catch mechanism configured for selectively releasing the first, penetrable target away from the second, reactive target and for connecting the first, penetrable target to the second, reactive target such that movement of the second, reactive target allows the first, penetrable target to move from the generally vertical position; and wherein the catch mechanism comprises a catch and a catch arm for holding the catch in place.

2. The target system according to claim 1, wherein the first, penetrable target is formed from paper or cardboard.

3. The target system according to claim 1, wherein the second, reactive target is formed from steel.

4. A target system comprising:

a first, penetrable target disposed in a generally vertical position;

a second, reactive target disposed so as to be concealed by the first penetrable target; and a catch mechanism connecting the first, penetrable target to the second, reactive target such that movement of the second, reactive target allows the first, penetrable target to move from the generally vertical position, wherein the catch mechanism comprises a catch and a catch arm for holding the catch in place and wherein the second, reactive target is attached to an arm, the catch arm also being attached to said arm, such that movement of the arm moves the catch arm and releases the catch.

5. The target system according to claim 4, wherein the first, penetrable target is part of a first target mechanism, the first target mechanism being gravitationally biased so that release of the catch mechanism allows the first target mechanism to rotate and thereby move the first, penetrable target out of the generally vertical position.

6. A method for target training, the method comprising:

selecting a first, penetrable target;

placing a second, reactive target so as to be concealed by the first, penetrable target; and causing the first, penetrable target to fall away from the second, reactive target when the second, reactive target is struck by a bullet.

7. A method for target training, the method comprising:

selecting a first, penetrable target;

placing a second, reactive target so as to be concealed by the first, penetrable target; and causing the first, penetrable target to fall when the second, reactive target is struck by a bullet, wherein the method comprises pivotably attaching the first, penetrable target and the second, reactive target to a support and disposing the first, penetrable target and the second, reactive target in communication with one another such that pivoting the second, reactive target away from the first, penetrable target causes the first, penetrable target to move.

8. The method according to claim 7, wherein the method comprises disposing the first, penetrable target in a generally vertical position, and wherein moving the second, reactive target releases the first, penetrable target and allows the first, penetrable target to fall from the generally vertical position.

9. A target system comprising:

a first, penetrable target disposed in a generally vertical position;

a second, reactive target disposed so as to be concealed by the first penetrable target; and a catch mechanism connecting the first, penetrable target to the second, reactive target such that movement of the second, reactive target rearwardly allows the first, penetrable target to move forward from the generally vertical position; and wherein the second, reactive target is disposed in a generally vertical position when the catch mechanism is connecting the first, penetrable target to the second, reactive target, and wherein impacting the second, reactive target with a bullet causes the second, reactive target to move rearwardly, thereby releasing the catch mechanism.

10. A target system comprising:

a first, penetrable target disposed in a generally vertical position;

a second, reactive target disposed so as to be concealed by the first penetrable target; and a catch mechanism connecting the first, penetrable target to the second, reactive target such that movement of the second, reactive target rearwardly allows the first, penetrable target to move forward from the generally vertical position; and wherein the second, reactive target is arm is attached to an arm and wherein the arm is adjustable so as to enable positioning of the second, reactive target at a plurality of locations behind the first, penetrable target.

* * * * *